US010045643B2

(12) United States Patent
Boyd

(10) Patent No.: US 10,045,643 B2
(45) Date of Patent: Aug. 14, 2018

(54) PILLOW

(71) Applicant: Dennis M. Boyd, St. Louis, MO (US)

(72) Inventor: Dennis M. Boyd, St. Louis, MO (US)

( * ) Notice: Subject to any disclaimer, the term of this patent is extended or adjusted under 35 U.S.C. 154(b) by 286 days.

(21) Appl. No.: 14/990,755

(22) Filed: Jan. 7, 2016

(65) Prior Publication Data

US 2016/0192794 A1 Jul. 7, 2016

Related U.S. Application Data

(60) Provisional application No. 62/100,892, filed on Jan. 7, 2015.

(51) Int. Cl.
*A47G 9/10* (2006.01)

(52) U.S. Cl.
CPC .... *A47G 9/1081* (2013.01); *A47G 2009/1018* (2013.01)

(58) Field of Classification Search
CPC ..... A47G 9/10
USPC ..... 5/636, 640, 644, 657
See application file for complete search history.

(56) References Cited

U.S. PATENT DOCUMENTS 4,916,765 A * 4/1990 Castronovo, Jr. .... A47G 9/1081 297/284.1
5,545,199 A * 8/1996 Hudson ..... A47G 9/1036 5/421
6,047,425 A * 4/2000 Khazaal ..... A47G 9/1027 5/640
6,317,908 B1 * 11/2001 Walpin ..... A47G 9/10 5/636
2011/0277216 A1 * 11/2011 Higgins ..... D06M 11/45 2/200.1
2012/0227185 A1 * 9/2012 Batiste ..... A47G 9/007 5/641

* cited by examiner

*Primary Examiner* — Fredrick C Conley
(74) *Attorney, Agent, or Firm* — Harness, Dickey & Pierce, P.L.C.

(57) ABSTRACT

A pillow includes a foam body having top and bottom faces, opposed first and second sides, and opposed left and right ends. A first raised ridge is adjacent to and extends parallel with the first side, projecting to a first height relative to the bottom face. A second raised ridge is adjacent to and extending parallel with the second side, projecting to a second height relative to the bottom face, the second height being different from the first height. There is a trough in the first face between the first and second ridges. First and second elongate passages are disposed in and extending parallel to the first raised ridges, respectively. First and second elongate elements can be disposed in the first and second elongate passages. A second body, of a different material than the first body, disposed in the trough. A cover substantially encloses the first and second bodies.

18 Claims, 4 Drawing Sheets

PILLOW

CROSS-REFERENCED APPLICATION

This application claims priority to U.S. provisional application Ser. No. 62/100,892 filed on Jan. 7, 2015. The disclosure of the above-referenced application is incorporated herein by reference in its entirety.

FIELD

The present disclosure relates to pillows.

BACKGROUND

This section provides background information related to the present disclosure which is not necessarily prior art.

Almost everyone uses a pillow to sleep. There are many different types of pillows to accommodate sleepers of various sizes and sleeping positions. For example a side sleeper with wider shoulders may desire a taller pillow than a person with narrower shoulder. A person who sleeps on his or her stomach generally prefers a smaller profile pillow to reduce neck strain, while a person who sleeps on his or her back generally prefers a medium height pillow. Different heights, widths, and lengths of pillows have been created to respond to the different physiological needs of the various consumer segments.

One issue with existing pillows is that many sleepers use multiple positions during the night (i.e., back, left side, right side, stomach) and a single pillow usually cannot accommodate all these sleeping positions. Another issue is temperature control—a significant amount of body heat is released through the head, heating the pillow and often causing the user to wake up to adjust the pillow to find a cooler position. In other situations it may be desirable for the pillow to actually apply heat to the user, for example to relieve tension and muscle aches or to simply keep the sleeper warm. In other situations it may be desirable to actively cool the user, for example to reduce swelling or prevent heat reflection.

This section provides a general summary of the disclosure, and is not a comprehensive disclosure of its full scope or all of its features.

SUMMARY

The various embodiments of the pillow of the present invention address one or more of these issues. One preferred embodiment provides a pillow comprising: a first foam body having top and bottom faces, opposed first and second sides, and opposed left and right ends. There is a first raised ridge adjacent to and extending parallel with the first side. This first raised ridge projects to a first height relative to the bottom face. There is a second raised ridge adjacent to and extending parallel with the second side. This second raised ridge preferably projects to a second height relative to the bottom face, the height of the second ridge being different from the height of the first ridge. However in some embodiments the first and second ridges can be of the same height. The first and second raised ridges preferably have a smooth, round transverse cross section.

The first and second raised ridges define a trough between them on the top face of the foam body. A second body, of a different material than the foam body, can be disposed in the trough. A cover preferably encloses the first and second bodies.

A first elongate passage is disposed in and extends generally parallel to the first raised ridge, and similarly a second elongate passage is disposed in and extends parallel to the second raised ridge. First and second elongate slots preferably connect the first and second elongate passages with the exterior of the first body, and more preferably with the trough between the raised ridges.

First and second elongate elements are preferably disposed in the first and second passages. In some embodiments these first and second elongate elements comprise foam. In other embodiments these first and second elongate elements comprise fluid fillable envelopes. In still other embodiments these first and second elongate elements comprise a gel-filled envelope.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
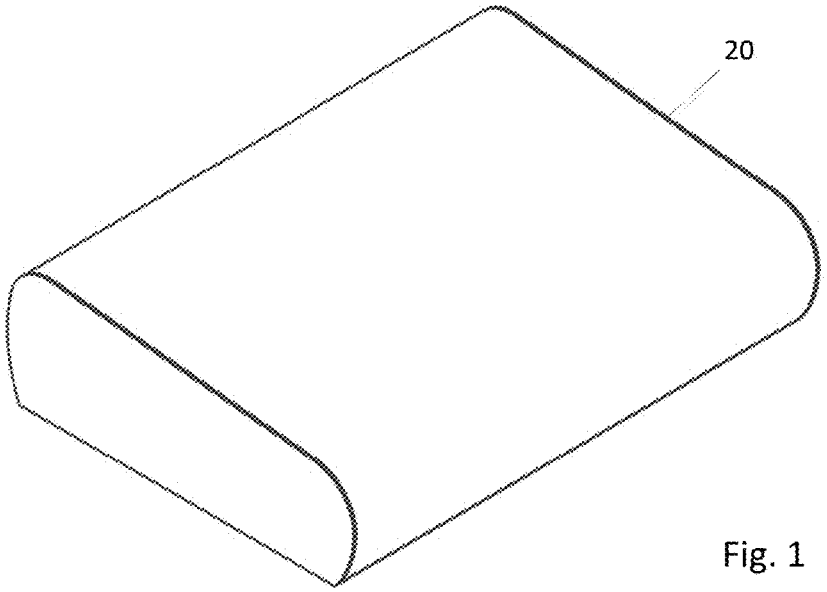
FIG. 1 is a perspective view of a preferred embodiment of pillow in accordance with the principles of this invention.
Figure 2:
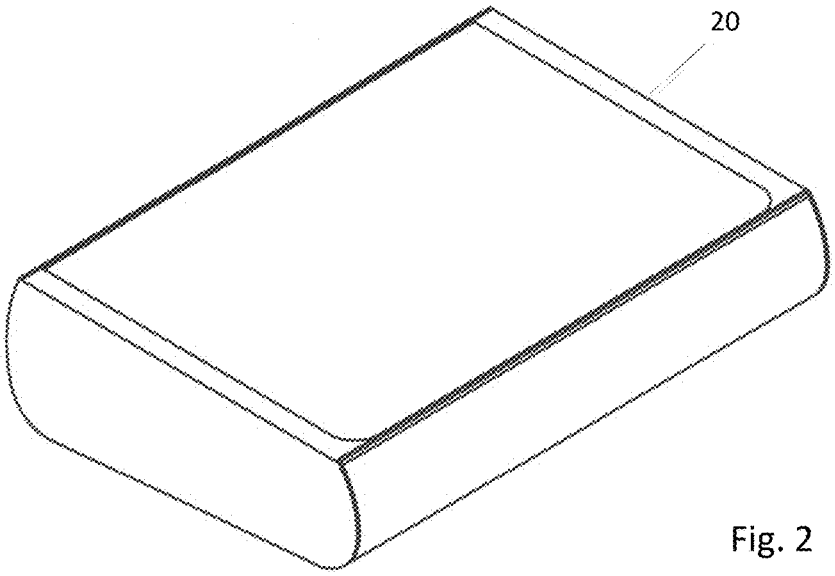
FIG. 2 is a perspective view of the bottom of the pillow of the preferred embodiment.
Figure 3:
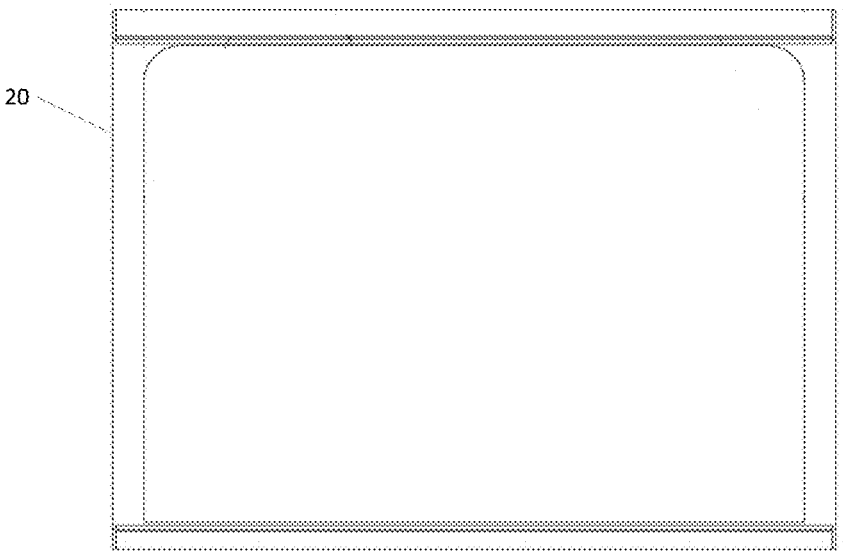
FIG. 3 is a bottom plan view of the pillow of the preferred embodiment.
Figure 4:
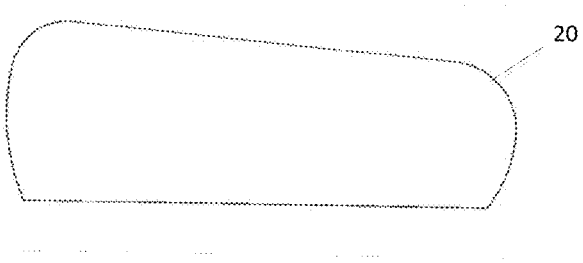
FIG. 4 is a left end elevation view of the pillow of the preferred embodiment.
Figure 5:
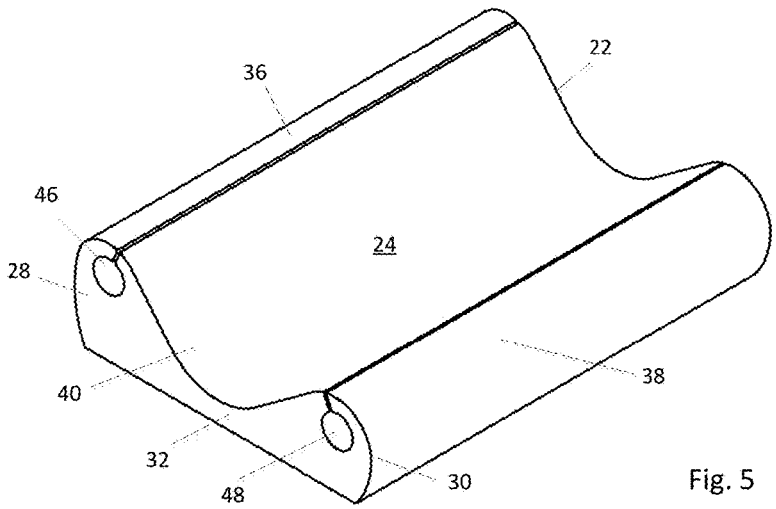
FIG. 5 is a top perspective view of the first foam body forming a part of the pillow of the preferred embodiment.
Figure 6:
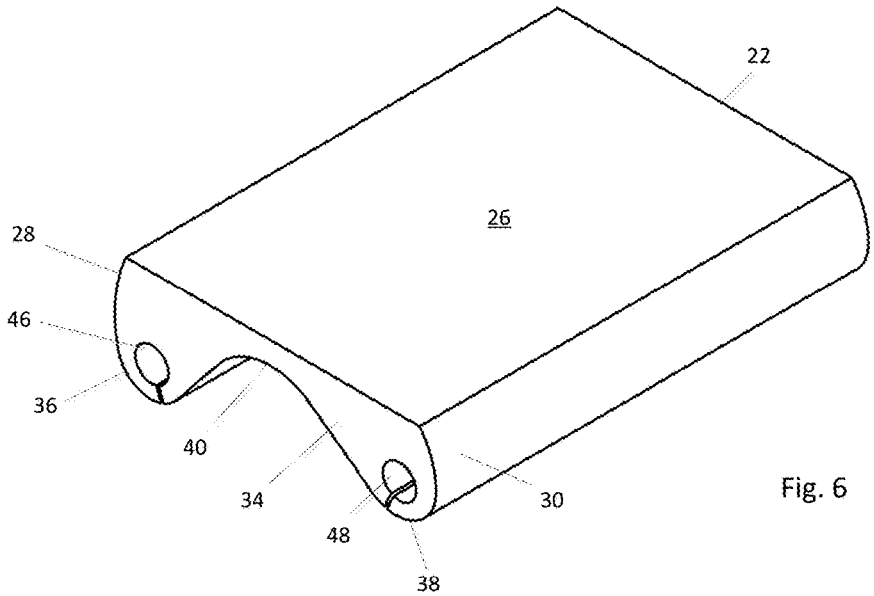
FIG. 6 is a bottom perspective view of the first foam body forming a part of the pillow of the preferred embodiment.
Figure 7:
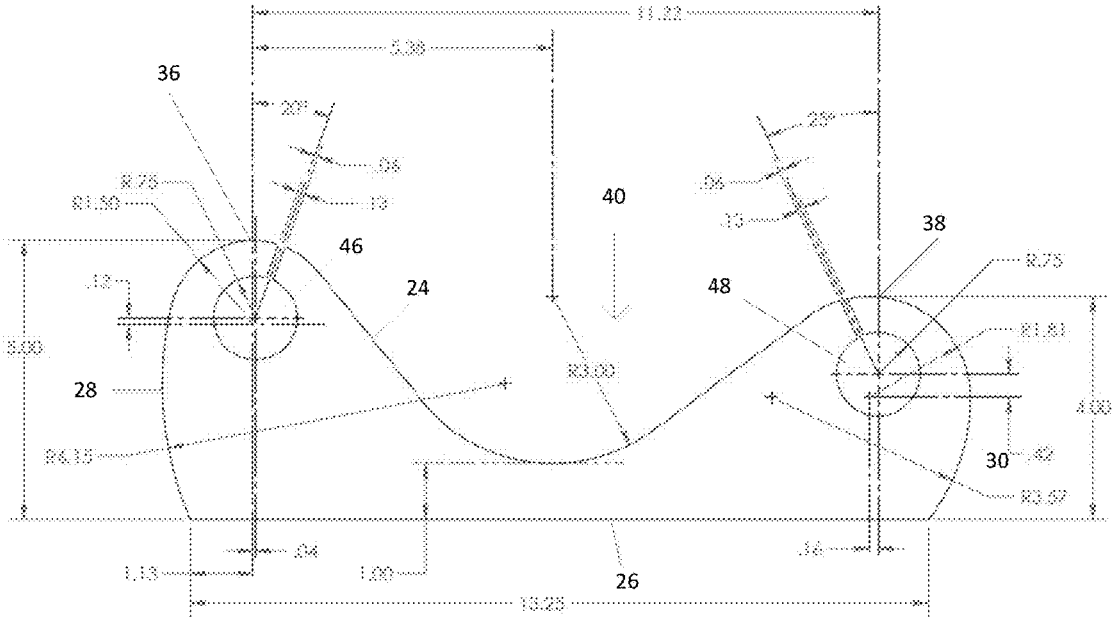
FIG. 7 is a side elevation view of the first foam body forming a part of the pillow of the preferred embodiment.
Figure 8:
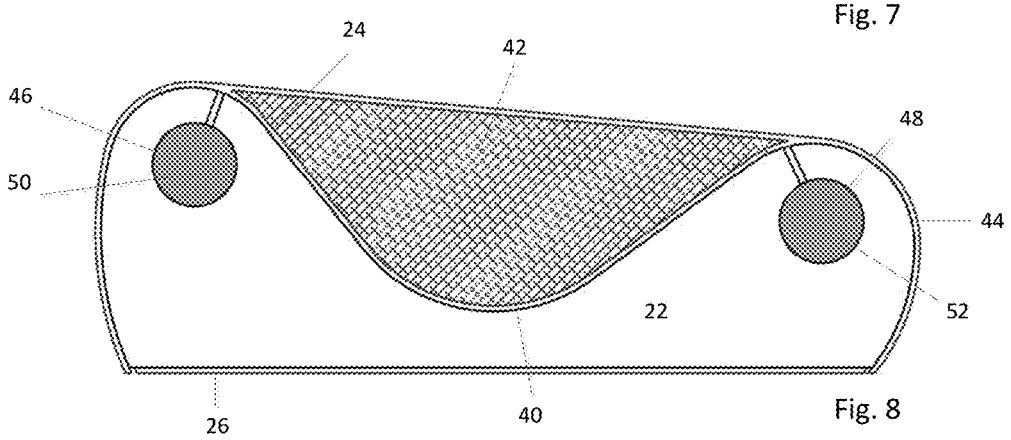
FIG. 8 is a side elevation view of the pillow of the preferred embodiment, with the cover removed.
Figure 9:
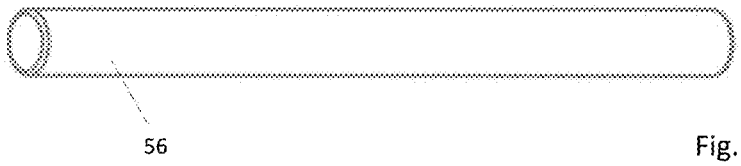
FIG. 9 is a side elevation view of an elongate element that can be used in the pillow of the preferred embodiment.

Example embodiments will now be described more fully with reference to the accompanying drawings.

A preferred embodiment of a pillow in accordance with the principles of this invention is indicated generally as 20 in the Figures. The pillow 20 comprises a first foam body 22 having top and bottom faces 24 and 26, opposed first and second sides 28 and 30, and opposed left and right ends 32 and 34. There is a first raised ridge 36 adjacent to and extending parallel with the first side 28. This first raised ridge 36 projects to a first height relative to the bottom face 26 (in this preferred embodiment 5 inches from the bottom face 26 to the crest of the ridge 36). There is a second raised ridge 38 adjacent to and extending parallel with the second side 30. This second raised ridge 38 preferably projects to a second height relative to the bottom face 26, the height of the second ridge being different from the height of the first ridge 36 (in this preferred embodiment 4 inches from the bottom face 26 to the crest of ridge 38). Of course, in some embodiments, the first and second ridges can be of the same height. The first and second raised ridges 36, 38 preferably have a smooth, round transverse cross section. The first and second raised ridges 36, 38 define a trough 40 between them on the top face 24 of the foam body 22.

The first foam body 22 is preferably made of a gel memory foam, i.e., a visco or memory foam infused with gel particles to reduce trapped body heat, speed up spring back time and help the foam feel softer. The gel memory foam may have other ingredients infused into it, including for example *eucalyptus*, aloe vera, green tea extract, or activated charcoal to control odors and/or provide aromatherapy. The gel memory foam preferable has a density of between about 2 lbs./$ft^3$ and about 7 lbs./$ft^3$, and stiffness of between about 8 IFD and about 35 IFD. (IFD measures the force (in pounds-force) required to make a dent 1 inch into a foam sample 15"×15"×4" by an 8-inch-diameter (50 $in^2$) disc—known as IFD @ 25% compression. IFD ratings for memory foams range between super soft (IFD 8) and semi-rigid (IFD 120).).

A second body 42, of a different material than the first foam body 22, can be disposed in the trough 40, extending from the crest of the first raised ridge 36 to the crest of the second raised ridge 38. The second body 42 can be made of fibers such as polyester, rayon, silk, wool, cashmere. Alternatively it can be made of latex, polyurethane, memory foam or gel memory foam—preferably of a lower IFD than the surrounding foam 22. The second body 42 can be enclosed in its own cover, which can be made of a stretchable fabric or other suitable material. In some embodiments, the second body can include a fluid filled or fluid fillable envelope containing air, water, or gel or other suitable material. A cover 44 preferably encloses the first and second bodies 22 and 42. The cover 44 can be made of a stretch knit fabric or other suitable material. When the outer cover 44 is removed it may also contain the contents of the second body 42 which may be attached to the outer cover for convenient washing.

The cover 44 may contain oxygenation fibers such as Celliant®—a synthetic polymer bi-component fiber made from polyethylene terephthalate with optically active particles embedded into the core, available from Hologenix, LLC, or similar material. Fabrics containing Celliant® are believed to increase oxygenation in body tissue and to reduce minor aches and pains. The cover may alternatively or in addition contain fibers of a phase change material (PCM) such as Outlast® available from Outlast Technologies. It may also contain natural fibers such as wool, cotton, bamboo, cashmere or silk or other natural or manmade fibers. Preferably it would also contain some spandex material (a polyester-polyurethane copolymer or similar material) of at least 3% to provide stretch as well as rebound to the fabric.

A first elongate passage 46 is disposed in and extends generally parallel to the first raised ridge 36, and similarly a second elongate passage 48 is disposed in and extends parallel to the second raised ridge 38. First and second passages 46 and 48 are preferably centered under the crest of their respective ridges 36 and 38. In this preferred embodiment, the first and second elongate passages 46 and 48 have a diameter of 1.5 inches, and extend from the first end 32 to the second end 34. First and second elongate slots 50 and 52 preferably connect the first and second elongate passages 46 and 48 with the exterior of the first body 22, and more preferably with the trough 40 between the raised ridges. In the preferred embodiment, the slot 50 is oriented at an angle of 20° with respect to vertical, and the slot 52 is oriented at an angle of 25° with respect to vertical. First and second elongate elements 54 and 56 are preferably disposed in the first and second passages 46 and 48, respectively.

In some embodiments these first and second elongate elements 54 and 56 comprise foam. In these embodiments, elements 54 and 56 of different firmnesses can be provided, and the user can select among the elements and install elements of the selected firmness to provide a desired level of softness or support. The elements 54 and 56 can be made of polyurethane foam, memory foam, gel memory foam, latex or other suitable material.

In other embodiments these first and second elongate elements 54 and 56 comprise fluid-fillable envelopes. For example the elements 54 and 56 can comprise elongate tubular envelopes made of vinyl, such as polyvinylchloride or thermoplastic polyurethane (TPU) with a nylon or polyester fabric laminated to it, or other suitable material. The envelope can have a reclosable valve that the user can use to fill the tubular elements 54 and 56 with a fluid, such as air or water, and provide different levels of softness or support by adjusting the level of fill.

In still other embodiments these first and second elongate elements 54 and 56 comprise a gel-filled envelope. For example the elements 54 and 56 can comprise elongate tubular envelopes made of vinyl, such as polyvinylchloride or thermoplastic polyurethane (TPU) with a nylon or polyester fabric laminated to it, or other suitable material. They can be filled with a cooling gel, such as a gel that has a high specific heat or phase change to provide heat absorption. The elements 54 and 56 can thus absorb heat from the user with relatively small increase temperature. Further the elements 54 and 56 can be heated, for example in a microwave, and can provide heat to the users. The elements 54 and 56 can also be cooled, for example in a refrigerator or freezer, to enhance their heat absorption ability.

The first and second ridges provide two different sleeping heights to accommodate sleepers who use multiple sleep positions throughout the night. For example the height of the first ridge on the first side of the pillow could be 5" or more while the height of the second ridge could be 3.5" or less. Generally the side sleeper would prefer the taller profile while the back and stomach sleeper would prefer the lower profile portion of the pillow. The pillow can also be rotated 180 degrees so that the user can transition from the taller profile side to the lower profile side or vice versa as their needs may dictate.

In some embodiments a central body of gel fiber is included that can be "fluffed" to create additional height in the desired area, and allows for an air flow between the foam and the user. This can reduce sweating caused by lack of ventilation between the neck/face and the foam.

In some embodiments, fluid filled element can be provided to adjust the firmness of the ridges and/or transfer heat to or from the user. In some embodiments channel can be provided in the foam body to allow for additional ventilation in the pillow. In some embodiments the elements can be heated (for example in the microwave) or cooled (for example in the refrigerator).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A pillow comprising: a first body having top and bottom faces, opposed first and second sides, and opposed left and right ends; a first raised ridge adjacent to and extending parallel with the first side; a second raised ridge adjacent to and extending parallel with the second side; a trough in the first face, between the first and second ridges;

a first elongate passage disposed in and extending parallel to the first raised ridge;

a second elongate passage disposed in and extending parallel to the second raised ridge;

a second elongate slot connecting the second elongate passage with the exterior of the first body; and a second body, of a different material than the first body, disposed in the trough;

and a cover substantially enclosing the first and second bodies;

a first elongate slot connecting the first elongate passage with the exterior of the first body, the first and second slots open to the trough between the raised ridges.

2. The pillow according to claim 1 wherein the second body comprises a fluid chamber.

3. The pillow according to claim 1, wherein the first ridge projects to a first height relative to the bottom face, and wherein the second ridge projects to a second height different from the first.

4. The pillow according to claim 1, wherein the cover comprises an oxygenating fiber.

5. The pillow according to claim 1, further comprising first and second elongate elements disposed in the first and second passages.

6. The pillow according to claim 5 wherein the first and second elongate elements comprise foam.

7. The pillow according to claim 5 wherein the first and second elongate elements comprise fluid-fillable envelopes.

8. The pillow according to claim 5 wherein the first and second elongate elements comprise a gel-filled envelope.

9. The pillow according to claim 5 wherein the second body comprises siliconized polyester fiber fill.

10. The pillow according to claim 1 wherein the second body comprises siliconized polyester fiber fill.

11. The pillow according to claim 1, wherein the cover includes a phase change material.

12. The pillow according to claim 1 wherein the first and second ridges have a smooth, round transverse cross section.

13. A pillow comprising: a foam body having top and bottom faces, opposed first and second sides, and opposed left and right ends; a first raised ridge adjacent to and extending parallel with the first side, projecting to a first height relative to the bottom face; a second raised ridge adjacent to and extending parallel with the second side, projecting to a second height relative to the bottom face, the second height being different from the first height; a trough in the first face, between the first and second ridges;

a first elongate passage disposed in and extending parallel to the first raised ridge;

a first elongate slot extending between the first elongate passage and surface of trough to provide access to the first elongate passage;

a second elongate passage disposed in and extending parallel to the second raised ridge;

a second elongate slot extending between the second elongate passage and surface of trough to provide access to the first elongate passage;

first and second elongate elements disposed in the first and second passages;

a second body, of a different material than the first body, disposed in the trough; and a cover substantially enclosing the first and second bodies.

14. The pillow according to claim 13 wherein the second body comprises siliconized polyester fiber fill.

15. The pillow according to claim 13 wherein the first and second elongate elements comprise foam.

16. The pillow according to claim 13 wherein the first and second elongate elements comprise fluid fillable envelopes.

17. The pillow according to claim 13 wherein the first and second elongate elements comprise a gel-filled envelope.

18. The chamber according to claim 17 wherein the second body comprises a fluid such as air, water, or gel.

* * * * *